US007854831B2

(12) United States Patent
Müllmaier

(10) Patent No.: US 7,854,831 B2
(45) Date of Patent: Dec. 21, 2010

(54) METHOD FOR THE MANUFACTURE OF SANITARY FITTINGS WITH A STAINLESS STEEL FINISH

(75) Inventor: Kurt Müllmaier, Sulzfeld (DE)

(73) Assignee: BLANCO Gmbh + Co KG, Oberderdingen (DE)

( * ) Notice: Subject to any disclaimer, the term of this patent is extended or adjusted under 35 U.S.C. 154(b) by 1417 days.

(21) Appl. No.: 11/224,636

(22) Filed: Sep. 12, 2005

(65) Prior Publication Data

US 2006/0060473 A1 Mar. 23, 2006

Related U.S. Application Data

(63) Continuation-in-part of application No. PCT/EP2004/002812, filed on Mar. 17, 2004.

(30) Foreign Application Priority Data

Mar. 19, 2003 (DE) ..... 103 12 308

(51) Int. Cl.
*C25D 5/14* (2006.01)
*C25D 5/34* (2006.01)
*C25D 5/48* (2006.01)
*C25D 5/52* (2006.01)

(52) U.S. Cl. ..... 205/180; 205/206; 205/208; 205/215; 205/219; 205/222; 205/223

(58) Field of Classification Search ..... 427/328, 427/367, 368, 405, 438; 205/206, 208, 215, 205/219, 222, 223, 182, 184, 187, 191, 180
See application file for complete search history.

(56) References Cited

U.S. PATENT DOCUMENTS 3,009,238 A * 11/1961 Knapp et al. ..... 428/645
3,533,921 A * 10/1970 Kalvonjian ..... 205/183
5,006,207 A * 4/1991 Peterman et al. ..... 205/120

FOREIGN PATENT DOCUMENTS

| | | | |
|---|---|---|---|
| DE | 1 496 930 | A | 12/1969 |
| DE | 14 96 930 | A | 12/1969 |
| DE | 1 621 156 | A | 4/1971 |
| DE | 16 21 156 | A | 4/1971 |
| DE | 1 771 181 | A | 11/1971 |
| DE | 17 71 181 | A | 11/1971 |
| DE | 197 10 623 | A1 | 11/1997 |
| DE | 198 46 589 | A1 | 4/2000 |
| EP | 0 504 704 | A | 9/1992 |
| EP | 0 504 704 | A1 | 9/1992 |
| EP | 0 997 556 | A | 5/2000 |
| EP | 1010777 | A2 * | 6/2000 |
| JP | 06270597 | A * | 9/1994 |

OTHER PUBLICATIONS

Carter, "The Finishing of Brass Stampings for Automotive Hardware", Monthly Review of the American Electroplater's Society (no month, 1932), vol. 19, No. 7, pp. 17-19.*
Dickman, "Mechanical Surface Preparation", © no month, 2002, pp. 31-50.*
Merriam-Webster's Collegiate Dictionary, tenth edition, © no month, 1997, p. 513.*

* cited by examiner

*Primary Examiner*—Edna Wong

(57) ABSTRACT

In order to provide sanitary fittings, in particular, water supply fittings and sanitary shut-off devices, in general, which visually and haptically are very similar to or scarcely distinguishable (stainless steel finish) from the stainless steel surface of stainless steel sinks, using starting materials which can be processed more cost-effectively, it is proposed that a fitting or fitting parts be manufactured from brass; the fittings or fitting parts be ground and polished; the visible surface of the fittings or fitting parts be nickel-plated; the nickel-plated surface of the fittings or fitting parts be ground and/or brushed; and the ground and/or brushed nickel-plated surface of the fittings or fitting parts be chromium-plated.

13 Claims, No Drawings

METHOD FOR THE MANUFACTURE OF SANITARY FITTINGS WITH A STAINLESS STEEL FINISH

This application is a continuation-in-part of International application No. PCT/EP04/002812 filed on Mar. 17, 2004, which claims priority and benefits of German application No. 103 12 308.3 filed on Mar. 19, 2003.

This application is a continuation of international application number PCT/EP2004/002812 filed on Mar. 17, 2004.

The present disclosure relates to the subject matter disclosed in international application number PCT/EP2004/002812 of Mar. 17, 2004 and German application number 103 12 308.3 of Mar. 19, 2003, which are incorporated herein by reference in their entirety and for all purposes.

BACKGROUND OF THE INVENTION

The invention relates to a method for the manufacture of a sanitary fitting with a stainless steel finish.

Sanitary fittings, particularly water supply fittings and sanitary shut-off devices, in general, are often used directly together with stainless steel sinks and have the disadvantage that they clearly differ, in particular, visually and haptically, from the material of the stainless steel sink.

Owing to the more complex processing in the case of stainless steel, the manufacture of such fittings from stainless steel proves to be very cost-intensive.

The object underlying the present invention is to propose sanitary fittings, in particular, water supply fittings and sanitary shut-off devices, in general, which visually and haptically are very similar to or scarcely distinguishable (stainless steel finish) from the stainless steel surface of stainless steel sinks, and a method for their manufacture, wherein starting materials which may be processed more cost-effectively are used.

SUMMARY OF THE INVENTION

The method according to the invention for the manufacture of sanitary fittings with a stainless steel finish may be applied to fittings and parts thereof, which are made from brass, zinc diecasting alloys and plastics. Depending on the starting material, slight modifications are required in the preparation of the fittings or parts thereof for the following common operations for nickel-plating and subsequent chromium-plating.

In a first variant of the invention, the fittings or parts thereof are made from brass, and these are first surface-polished. Subsequently (or alternatively) a pre-brushing is recommended.

The pre-brushing is recommended particularly for parts with recesses, and, in particular, the recesses should be pre-brushed.

In a second variant of the invention, plastic materials are used.

As a rule, plastic materials do not require any such pretreatment, although they may be coated with a layer of copper for better processing in the subsequent nickel-plating process.

In a third variant of the invention, the fittings or parts thereof are made from zinc diecasting alloys.

When fitting parts or fittings made of zinc diecasting alloys are used, the surface must first be plated with copper in order to close the surface pores present in zinc diecasting alloy parts (particularly ZAMAK alloy parts) and to obtain a sufficiently smooth surface.

Following the above-described pretreatment of the parts, the further procedure is as follows:

nickel-plating at least the visible surface of the fitting or the fitting parts;

grinding and/or brushing the nickel-plated surface of the fitting parts;

chromium-plating the ground and/or brushed nickel-plated surface of the fitting parts.

Surprisingly, by imparting a typical brush pattern after the nickel-plating of the surfaces, an effect is obtained with the following chromium-plating, as is known from stainless steel surfaces, which still shines through as brush pattern. By selecting suitable layer thicknesses, the metal layers of nickel and chromium may be combined so as to obtain a silver-gray, dull gloss, which essentially corresponds to the silver-gray tint of stainless steel. In particular, a yellow tinge, as is known in the case of nickel-plated surfaces, is avoided, and, on the other hand, the blue tinge of a standard chromium-plated surface is also avoided.

The brushing of the nickel surface should preferably result in a surface structure as is obtained with 3M wheels of the SBI-A type, 250 mm diameter and a working speed of 600 revolutions per minute.

Prior to the nickel-plating, the fitting parts are preferably degreased in one or preferably several separate operations, and it is further preferred for a chemical degreasing, an ultrasonic degreasing and an electrolytic degreasing operation to follow one another.

The nickel bath preferably comprises 60 to 80 grams of nickel metal per liter, which is preferably furnished in the form of nickel chloride and nickel sulfate.

A preferred additive in the electrolytic nickel bath is boric acid, which is preferably added in the amount of 30 to 50 grams per liter, in particular, preferably 40 grams per liter.

The nickel-plating is preferably carried out with a current density of 4 to 5 amps per square decimeter. Lower current densities are used for nickel-plating brass parts, and higher current densities in the case of previously copper-plated ZAMAK or plastic (particularly ABS) parts.

The above-mentioned degreasing operations last, as a rule, fractions of minutes or only a few minutes. The nickel-plating operation, on the other hand, will preferably last 15 to 25 minutes, depending on what average nickel layer thickness is to be produced on the component. With the above-mentioned specifications, an average nickel layer thickness in the range of 18 to 24 μm is obtained. It has been found that such layer thicknesses are sufficient to withstand a subsequent brushing procedure, as described hereinabove, and to produce an adequate brush structure. Larger layer thicknesses are, of course, possible, for the present invention, but this does not result in any greater advantages in the appearance of the parts. In any case, the layer thickness of the nickel layer must be large enough for a closed nickel surface to remain after the brushing procedure.

After the nickel-plating, the parts are rinsed, preferably with demineralized water at the end. The parts are subsequently dried in a kiln at a temperature of 60 to 75° C.

The nickel-plating is then followed by a chromium-plating, which may be carried out in the same manner for all parts.

Owing to the previously applied layer of nickel, the parts no longer differ outwardly, i.e., with respect to the electrolytic bath, so that the following recommendations apply to the processing of brass, zinc diecasting alloys and also to plastic parts.

For the nickel-plating, it is advisable, depending on the starting material, to carry out a number of degreasing operations, starting with a chemical degreasing, an ultrasonic degreasing and an electrolytic degreasing, before the parts are subjected to the nickel-plating. This will be explained in detail hereinbelow.

Prior to the chromium-plating, degreasing operations are also to be performed after the brushing of the nickel-plated surfaces. However, these are to be carried out for all fittings and fitting parts thereof irrespective of what starting material they are made from. Here, too, it is advisable to carry out a number of degreasing operations, which include a chemical, an ultrasonic and an electrochemical degreasing.

The electrolyte bath for the chromium-plating preferably contains chromium trioxide in an amount of 300 to 350 grams per liter, smaller amounts of sulfuric acid and a common catalyst. The chromium-plating process usually lasts 3 to 4 minutes and is carried out at a current strength of preferably 6.5 to 8 amps per square decimeter at a voltage of 3.2 to 5.6 volts. Under these conditions, an average layer thickness in the range of 0.1 to 0.3 μm is obtained.

This chromium layer thickness is adequate for many applications. For surfaces exposed to harsh conditions, particularly those which are often cleaned with abrasive cleaning agents or cleaning equipment, significantly thicker chromium layer thicknesses are recommended, but it must be ensured that the brush structure will shine through to a sufficient extent.

Details of the individual nickel-plating and chromium-plating processes will now be given before the nickel-plating and chromium-plating of brass, ZAMAK and ABS parts is explained in detail with reference to concrete examples.

Nickel-Plating Brass Parts

In a first operation, the polished and optionally pre-brushed brass parts are subjected to an ultrasonic degreasing in an aqueous medium at a temperature of 60 to 85° C., preferably approximately 75° C. The aqueous medium contains a degreasing agent, selected from tensides, aminically saponified fatty acids, weak organic acids and/or glycol ethers in respectively effective amounts.

In a further operation, a chemical degreasing is carried out once or several times at temperatures preferably in the range of 40 to 60° C. using an aqueous degreasing medium containing alkali hydroxide as main constituent and, in addition, further constituents selected from alkali metasilicate, sodium carbonate as well as phosphates and tensides. Solutizers, in particular, weak sequestrants may also be present.

Alkyl benzene sulfonates and ethoxylated fatty alcohols are used as dispersants and/or tensides.

In multiple chemical degreasing processes, the amount of degreasing agent in the medium is preferably reduced, for example, halved with each further degreasing operation.

Following this, a cathodic degreasing using an aqueous medium containing alkali hydroxide as main constituent of the degreasing agents is preferably carried out. In addition, the medium may contain one or several alkali silicates, sodium carbonate, phosphates and tensides.

In a further degreasing operation, which is carried out as anodic degreasing, a medium is used as described hereinabove for the cathodic degreasing, but preferably with a smaller amount of degreasing agent in the medium. Here, for example, half of the degreasing agent in the medium may suffice.

The anodic and the cathodic degreasing may also be carried out in reverse order, and, in either case, it applies for the respective second electrolytic degreasing operation that the smaller amount of degreasing agent will preferably be used here in the medium.

Finally, rinsing, neutralizing and rinsing again are carried out prior to the nickel-plating, with sulfuric acid preferably being used for the neutralizing. The rinsing procedures are carried out once or several times.

This is now followed by the actual nickel-plating process with a nickel content in the electrolyte of preferably 60 to 80 grams nickel content per liter. The nickel content is made from nickel salts which are preferably nickel chloride hexahydrate and nickel sulfate hexahydrate. It is particularly preferred for these two salts to be used alongside each other, with a ratio of approximately 1:4 being particularly preferred. Boric acid with a content of 30 to 40 grams per liter is used as further constituent of the electrolyte for the nickel-plating.

The length of time of the nickel-plating process does, of course, depend largely on the layer thickness aimed at. Usually, 15 to 25 minutes at a voltage of 6.2 to 8.3 volts and a current density of approximately 4 amps per square decimeter will be sufficient for the nickel-plating. The thus formed nickel layer has an average layer thickness in the range of 18 to 24 μm. This layer thickness is thick enough for a brush structure to be able to be imparted to the surface. Visually and haptically, the brush structure should correspond to a brush structure such as obtained with grinding wheels of the company 3M of the SBI-A type having a diameter of 250 mm, when these grinding wheels are driven at a working speed of 600 revolutions per minute.

Nickel-Plating Copper-Plated ZAMAK Parts and Plastic Parts

The ZAMAK parts (generally zinc diecasting alloy parts) are first provided with a copper layer in order to smooth the surface, i.e., in order to close surface pores resulting from the diecasting and ensure a smooth surface. After this, the copper-plated ZAMAK parts can be treated like the ABS parts, whether these are copper-plated or not.

A chemical degreasing is first carried out in an aqueous medium with a degreasing agent which is predominantly formed by alkali hydroxide, but, in addition, contains larger amounts of sodium carbonate, alkali metasilicates and alkylphenol ethoxylates. Tensides in a smaller amount may also be present.

Subsequently, an ultrasonic degreasing is carried out, with a degreasing agent formed predominantly by sodium borate and sodium carbonate being added to the aqueous degreasing medium. In addition, a mixture of various tensides is used.

As further degreasing operation, a cathodic and then an anodic degreasing is carried out. In this connection, the medium essentially contains sodium carbonate and sodium metasilicates and smaller amounts of sodium hydroxide as degreasing agent.

Prior to the actual nickel-plating, neutralizing is carried out again. Here sulfuric acid is preferably used and rinsing is carried out again with water. The nickel-plating process is then carried out, as described hereinabove, but a somewhat higher current density is preferably used for the ZAMAK parts and ABS parts.

Here, too, nickel layer thicknesses in the range of 18 to 24 μm are obtained in a period of time of 15 to 25 minutes.

The thus obtained layer thicknesses are treated as described hereinabove, with the brushing procedure, similarly described hereinabove, then being carried out after drying in the kiln.

Chromium-Plating the Nickel-Plated and Brushed Fittings (Fitting Parts)

This is now followed by the actual chromium-plating process, which is the same for all sanitary fitting parts, irrespective of whether they are based on brass parts, ZAMAK parts or ABS parts.

A chemical degreasing is first carried out. Here an aqueous degreasing medium containing degreasing agents predominately formed by sodium hydroxide is used. Considerable amounts of sodium carbonate, small amounts of sodium metasilicate and alkylphenol ethoxylates and tensides are additionally contained therein.

An ultrasonic degreasing is then carried out in an aqueous degreasing medium with a degreasing agent formed predominantly from sodium borate and smaller amounts of sodium carbonate and various tensides.

Thereafter, rinsing and neutralizing with sulfuric acid are carried out, followed by rinsing again, and the actual chromium-plating is then carried out.

The chromium-plating is carried out with a chromium content of 300 to 350 grams per liter of chromium trioxide, small amounts of sulfuric acid and a catalyst comprised of fluorsilicates and sodium chromate.

The chromium-plating is carried out for 3 to 4 minutes at a current strength of 6.5 to 8 amps per square decimeter and at a voltage of 3.2 to 5.6 volts.

During this time and under these conditions, average chromium layer thicknesses of 0.1 to 0.3 μm are obtained.

Rinsing with water is then carried out, at the end with ultrapure water, and, subsequently, drying in the kiln.

The thus obtained fitting parts have a surface appearance and a surface feel which are scarcely distinguishable from the stainless steel finish of real brushed stainless steel surfaces.

By way of example, the individual method stages will be set forth hereinbelow in the form of a table. It will be understood that, in particular, the degreasing operations may be performed in a wide variety of different ways, and merely serve to create the preconditions for nickel and chromium layers with good adherence. The nickel-plating and chromium-plating processes themselves also allow many variations, the main thing being that the above-described results must be attained for the layer thicknesses.

Nickel-Plating Brass Parts

| Process | Temperature | Product | Concentration | Time | Voltage | Absorption |
|---|---|---|---|---|---|---|
| Ultrasonic degreasing | 75° C. | A | 40 g/l | 3 min. | | |
| Degreasing | 55° C. | B | 40 g/l | 4 min. | | |
| Rinsing | 16/20° C. | water | | | | |
| Cathodic degreasing | 22° C. | C | 34 g/l | 1 min. | | |
| Anodic degreasing | 22° C. | C | 17 g/l | 0.5 min. | | |
| Rinsing | 16/20° C. | water | | | | |
| Neutralization | ambient temperature | sulfuric acid PPA | 10 g/l | 0.5 min. | | |
| Rinsing | 16/20° C. | water | | | | |
| Nickel-plating | | nickel metal | 70 g/l | 18 min. | 6.2/8.3 V | 4 amp/dm$^2$ |
| | | nickel chloride | 60 g/l | | | |
| | | nickel sulfate | 250 g/l | | | |
| | | boric acid | 40 g/l | | | |
| Rinsing | 16/20° C. | water | | | | |
| Rinsing | 16/20° C. | demineralized water | | | | |
| Kiln drying | 65/70° C. | | | 3 min. | | |

Nickel-Plating Copper-Plated ZAMAK Parts and ABS Parts

| Process | Temperature | Product | Concentration | Time | Voltage | Absorption |
|---|---|---|---|---|---|---|
| Degreasing | 55° C. | D | 18 g/l | 0.5 min. | | |
| Ultrasonic degreasing | 70° C. | E | 12 g/l | 0.5 min. | | |
| Rinsing | 16/20° C. | water | | | | |
| Cathodic degreasing | ambient temperature | F | 30 g/l | 3 min. | | |
| Anodic degreasing | ambient temperature | F | 15 g/l | 20 sec. | | |
| Rinsing | 16/20° C. | water | | | | |
| Neutralization | ambient temperature | sulfuric acid PPA | 10 g/l | 0.5 min. | | |
| Rinsing | 16/20° C. | water | | | | |
| Nickel-plating | | nickel metal | 70 g/l | 18 min. | 6.2/8.3 V | 5 amp/dm$^2$ |
| | | nickel chloride | 60 g/l | | | |

-continued

| Process | Temperature | Product | Concentration | Time | Voltage | Absorption |
|---|---|---|---|---|---|---|
| | | nickel sulfate | 250 g/l | | | |
| | | boric acid | 40 g/l | | | |
| Rinsing | 16/20° C. | water | | | | |
| Rinsing | 16/20° C. | demineralized water | | | | |
| Kiln drying | 65/70° C. | | | 3 min. | | |

Chromium-Plating Brass Parts, ZAMAK Parts and ABS Parts

| Process | Temperature | Product | Concentration | Time | Voltage | Absorption |
|---|---|---|---|---|---|---|
| Degreasing | 55° C. | D | 18 g/l | 5 sec. | | |
| Ultrasonic degreasing | 70° C. | E | 12 g/l | 5 sec. | | |
| Rinsing | 16/20° C. | water | | | | |
| Cathodic degreasing | 70° C. | F | 30 g/l | 2 min. | | |
| Rinsing | 16/20° C. | water | | | | |
| Neutralization | | sulfuric acid PPA | 10 g/l | 2/3 min. | | |
| Rinsing | 16/20° C. | water | | | | |
| Chromium | | chromium trioxide | 310 g/l | 3-4 min | 3.2-5.6 V | 6.5-8.0 amp/dm$^2$ |
| | | sulfuric acid | 1.3 g/l | | | |
| | | catalyst | 15.5 g/l | | | |
| Rinsing | 16/20° C. | water | | | | |
| Rinsing | 16/20° C. | ultrapure water | | | | |
| Kiln drying | 55/60° C. | | | 0.5 min. | | |

Explanations of the codes used in the tables:

(A) mixture of tensides, aminically saponified fatty acids, weak organic acids, glycol ethers (B) mixture, containing sodium hydroxide as main constituent, and, in addition, sodium metasilicate, sodium carbonate, solutizers in the form of weak sequestrants, phosphates, alkyl benzene sulfonates and fatty alcohols (C) mixture, containing sodium hydroxide, sodium metasilicate and sodium carbonate as main constituents, and, in addition, sequestrants, phosphates and tensides (D) mixtures, containing sodium hydroxide as main constituent, and, in addition, sodium carbonate, sodium silicate, alkylphenol ethoxylate, tensides (E) mixtures, containing sodium borate as main constituent, and, in addition, sodium carbonate, tensides (F) mixtures of the main constituents sodium carbonate, sodium metasilicate, sodium hydroxide Catalyst fluorsilicate in combination with sodium chromate.

In the specification, the trademark ZAMAK zinc diecasting alloy parts refers to parts made from zinc alloys that contain aluminum, magnesium, and copper and that are available in the United States from Eastern Alloys, Inc., Maybrook, N.Y.

The invention claimed is:

1. Method for the manufacture of sanitary fittings with a stainless steel finish, comprising:

manufacturing fittings or fitting parts from brass;

grinding and polishing the fittings or fitting parts;

nickel-electroplating the visible surface of the fittings or fitting parts;

grinding and/or brushing the nickel-electroplated surface of the fittings or fitting parts; and chromium-electroplating the ground and/or brushed nickel-electroplated surface of the fittings or fitting parts.

2. Method in accordance with claim 1, wherein pridr to the nickel-electroplating, the fitting parts are subjected to a degreasing once or several times, with chemical, electrochemical and/or ultrasonic degreasing being employed.

3. Method in accordance with claim 2, wherein the degreasing is carried out at elevated temperatures in an aqueous medium.

4. Method in accordance with claim 2, wherein the electrochemical degreasing comprises both anodic and cathodic degreasing.

5. Method in accordance with claim 1, wherein an electrolyte bath for the nickel-electroplating contains metallic nickel in an amount of 60 to 80 grams per liter.

6. Method in accordance with claim 5, wherein the metallic nickel in the electrolyte bath is formed by nickel chloride and/or nickel sulfate.

7. Method in accordance with claim 6, wherein the metallic nickel is formed by nickel chloride and nickel sulfate in the ratio of nickel chloride to nickel sulfate of approximately 1:4.

8. Method in accordance with claim 5, wherein the electrolyte bath further contains boric acid in an amount of 30 to 50 grams per liter.

9. Method in accordance with claim 1, wherein the nickel-elecroplating is applied to the fittings or fitting parts with a thickness of 18 to 24 μm on average.

10. Method in accordance with claim 1, wherein prior to the chromium-electroplating, a chemical degreasing, an ultrasonic degreasing and/or an electrolytic degreasing are carried out, and individual degreasing operations may be repeated several times.

11. Method in accordance with claim 10, wherein the electrolytic degreasing is a cathodic degreasing.

12. Method in accordance with claim 1, wherein the chromiun-electroplating is carried out in a chromium bath containing 300 to 350 grams of chromium trioxide per liter.

13. Method in accordance with claim 1, wherein the brushing is carried out before the chromium-electroplating in such a way as to obtain a brush pattern that shines through the following chromium-electroplating.

* * * * *

UNITED STATES PATENT AND TRADEMARK OFFICE

CERTIFICATE OF CORRECTION

PATENT NO. : 7,854,831 B2
APPLICATION NO. : 11/224636
DATED : December 21, 2010
INVENTOR(S) : Kurt Müllmaier It is certified that error appears in the above-identified patent and that said Letters Patent is hereby corrected as shown below:

Column 8, Claim 2, line 43, replace “pridr” with: --- “prior”.

Signed and Sealed this
Tenth Day of May, 2011

David J. Kappos

David J. Kappos
*Director of the United States Patent and Trademark Office*